US008803780B2

(12) United States Patent
Kim et al.

(10) Patent No.: US 8,803,780 B2
(45) Date of Patent: Aug. 12, 2014

(54) LIQUID CRYSTAL DISPLAY HAVING A FUNCTION OF SELECTING DOT INVERSION AND METHOD OF SELECTING DOT INVERSION THEREOF

(75) Inventors: Jongwoo Kim, Namyul-ri (KR); Hyuntaek Nam, Daegu (KR); Suhyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 700 days.

(21) Appl. No.: 12/830,971

(22) Filed: Jul. 6, 2010

(65) Prior Publication Data

US 2011/0037760 A1 Feb. 17, 2011

(30) Foreign Application Priority Data

Aug. 14, 2009 (KR) ..... 10-2009-0075382

(51) Int. Cl.
*G09G 3/36* (2006.01)

(52) U.S. Cl.
USPC ..... 345/96; 345/209

(58) Field of Classification Search
USPC ..... 345/96, 209
See application file for complete search history.

(56) References Cited

U.S. PATENT DOCUMENTS

| | | | | |
|---|---|---|---|---|
| 6,064,363 | A * | 5/2000 | Kwon | 345/98 |
| 7,965,286 | B2 * | 6/2011 | Ryu et al. | 345/209 |
| 8,232,950 | B2 * | 7/2012 | Cha et al. | 345/96 |
| 2008/0001890 | A1 * | 1/2008 | Song et al. | 345/96 |

FOREIGN PATENT DOCUMENTS

| | | | | |
|---|---|---|---|---|
| CN | 101226722 | A | 7/2008 | |
| KR | 20040010372 | A | 1/2004 | |
| KR | 1020090041489 | A * | 4/2009 | G09G 3/36 |

OTHER PUBLICATIONS

Office Action issued in corresponding Chinese Patent Application No. 201010188767.3, mailed Sep. 28, 2012.

* cited by examiner

*Primary Examiner* — Kwang-Su Yang
(74) *Attorney, Agent, or Firm* — Brinks Gilson & Lione

(57) ABSTRACT

A liquid crystal display includes: a liquid crystal display panel including data lines and gate lines crossing each other; a timing controller that maps data of an input image to polarity patterns of 1-dot inversion and 2-dot inversion, counts the number of positive data and the number of negative data, determines whether any one of the positive data and negative data becomes dominant or not based on a difference between the counted numbers, and selects either one of the 1-dot and 2-dot inversions; a data driving circuit that converts the data of the input image into data voltages to be supplied to the data lines and inverts the polarity of the data voltages by the selected dot inversion; and a gate driving circuit that sequentially supplies gate pulses synchronized with the data voltages to the gate lines.

5 Claims, 13 Drawing Sheets

LIQUID CRYSTAL DISPLAY HAVING A FUNCTION OF SELECTING DOT INVERSION AND METHOD OF SELECTING DOT INVERSION THEREOF

This application claims the priority and the benefit under 35 U.S.C. §119(a) on Patent Application No. 10-2009-0075382 filed in Republic of Korea on Aug. 14, 2009 the entire contents of which are hereby incorporated by reference.

BACKGROUND

1. Field of the Invention

This document relates to a liquid crystal display and a method of controlling dot inversion thereof.

2. Discussion of the Related Art

An active matrix type liquid crystal display displays moving images using thin film transistors (hereinafter, referred to as "TFTs") as switching elements. In comparison with a cathode ray tube (CRT), the liquid crystal display can have a smaller size. Thus, the liquid crystal display is used as displays in portable information devices, office equipment, computers, televisions, etc., and hence is fast replacing the cathode ray tube.

Liquid crystal cells of the liquid crystal display display a picture image by changing transmittance by a potential difference between a data voltage supplied to a pixel electrode and a common voltage supplied to a common electrode. The liquid crystal display is generally driven by an inversion scheme of periodically inverting the polarity of the data voltage applied to the liquid crystal cell in order to prevent deterioration of the liquid crystal. When the liquid crystal display is driven by an inversion scheme, the liquid crystal display may have a low picture quality according to a correlation between the polarities of data voltages charged in the liquid crystal cells and a data pattern of an input image. This is because the polarity of data voltages charged in the liquid crystal cells are not balanced between the positive and negative polarities but either of the positive and negative polarities becomes dominant, and hence the common voltage applied to the common electrode is shifted. Once the common voltage is shifted, the reference potential of the liquid crystal cells is shifted, and this causes a viewer to feel flicker or smear on an image displayed on the liquid crystal display.

FIGS. 1 and 2 show data examples of problem patterns which may cause degradation of picture quality when driving a liquid crystal display by dot inversion.

Among the problem patterns, a pattern, as shown in FIG. 1, in which (white) pixel data having a white gray scale and (black) pixel data having a black gray scale alternate in units of one pixel is referred to as a shutdown pattern. Each pixel data comprises red subpixel data (R), green subpixel data (G), and blue subpixel data (B). As for a shutdown pattern detection method, shutdown patterns included in an input image are counted and whether the input image is data of a shutdown pattern or not is determined in accordance with the count value. In the shutdown pattern detection method, for example, if N-th (N is a positive integer) pixel data is white gray scale pixel data and (N+1)-th pixel data is black gray scale pixel data, the count value of a problem pixel counter is increased by 1 at a time, and the data of the input image is judged as having a shutdown pattern when the count value is above a predetermined threshold value.

Among the problem patterns, a pattern, as shown in FIG. 2, in which (white) pixel data having a white gray scale and (black) pixel data having a black gray scale alternate in units of two pixels is referred to as a smear pattern. As for a smear pattern detection method, similarly to the shutdown pattern method, smear patterns included in an input image are counted and whether the input image is data of a smear pattern or not is determined in accordance with the count value. In the smear pattern detection method, for example, if N-th pixel data and (N+1)-th pixel data are white gray scale pixel data and (N+2)-th pixel data and (N+3)-th pixel data are black gray scale pixel data, the count value of the problem pixel counter is increased by 1 at a time, and the data of the input image is judged as having a smear pattern when the count value is above a predetermined threshold value.

The problem patterns include various types of patterns that cause degradation of picture quality in dot inversion, as well as the shutdown pattern and the smear pattern. One of these patterns is a flicker pattern as shown in FIG. 14. In the flicker pattern, white gray scale subpixel data and black gray scale subpixel data alternate up and down and left and right.

However, a method of detecting a problem pattern from an input image involves storing a large amount of problem pattern data in advance for each problem pattern, and a large number of detection logic modules are required to detect each of the problem pattern data. For instance, in order to recognize a shutdown pattern, it is necessary to define, in advance, a maximum of $(2^3-1)\times2=14$ patterns as shown in FIG. 3 that may appear in six subpixels, and a detection logic module for detecting each of the patterns is required. In case of the smear pattern, it is necessary to define, in advance, a maximum of $(2^6-1)\times2=126$ patterns that may appear in 12 subpixel data, and a detection logic module for detecting each of the patterns is required.

BRIEF SUMMARY

In one aspect, a liquid crystal display includes: a liquid crystal display panel including data lines and gate lines crossing each other; a timing controller that maps data of an input image to polarity patterns of 1-dot inversion and 2-dot inversion, counts the number of positive data and the number of negative data, determines whether any one of the positive data and negative data becomes dominant or not based on a difference between the counted numbers, and selects either one of the 1-dot and 2-dot inversions; a data driving circuit that converts the data of the input image into data voltages to be supplied to the data lines and inverts the polarity of the data voltages by the selected dot inversion; and a gate driving circuit that sequentially supplies gate pulses synchronized with the data voltages to the gate lines.

In another aspect, a method of controlling dot inversion of a liquid crystal display includes: mapping data of an input image to polarity patterns of 1-dot inversion and 2-dot inversion and counting the number of positive data and the number of negative data; selecting either one of the 1-dot and 2-dot inversions by determining whether any one of the positive data and negative data becomes dominant or not based on a difference between the number of positive data and the number of negative data; converting the data of the input image into data voltages, inverting the polarity of the data voltages by the selected dot inversion, and supplying the data voltages to data lines of a liquid crystal display panel; and sequentially supplying gate pulses synchronized with the data voltages to gate lines of the liquid crystal display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Figure 1:
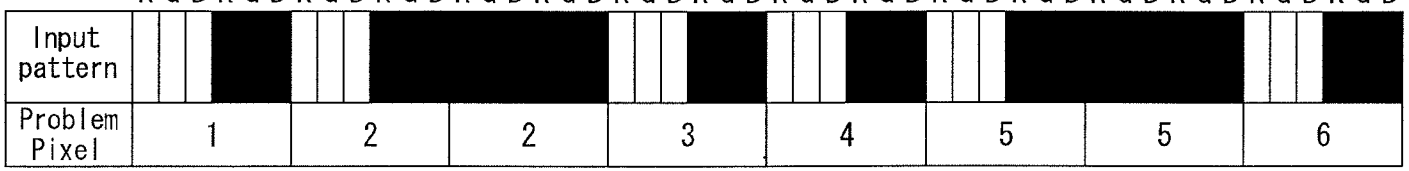
FIG. 1 (RELATED ART)
FIGS. 1 to 3 are views showing examples of problem patterns that may cause a common voltage shift.
Figure 2:
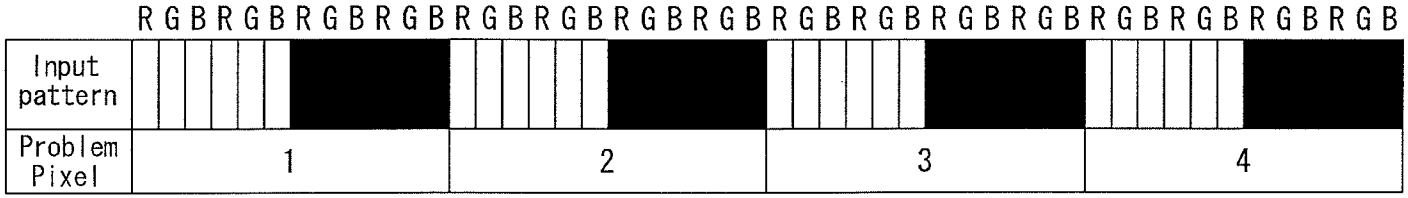
FIG. 2 (RELATED ART)
Figure 3:
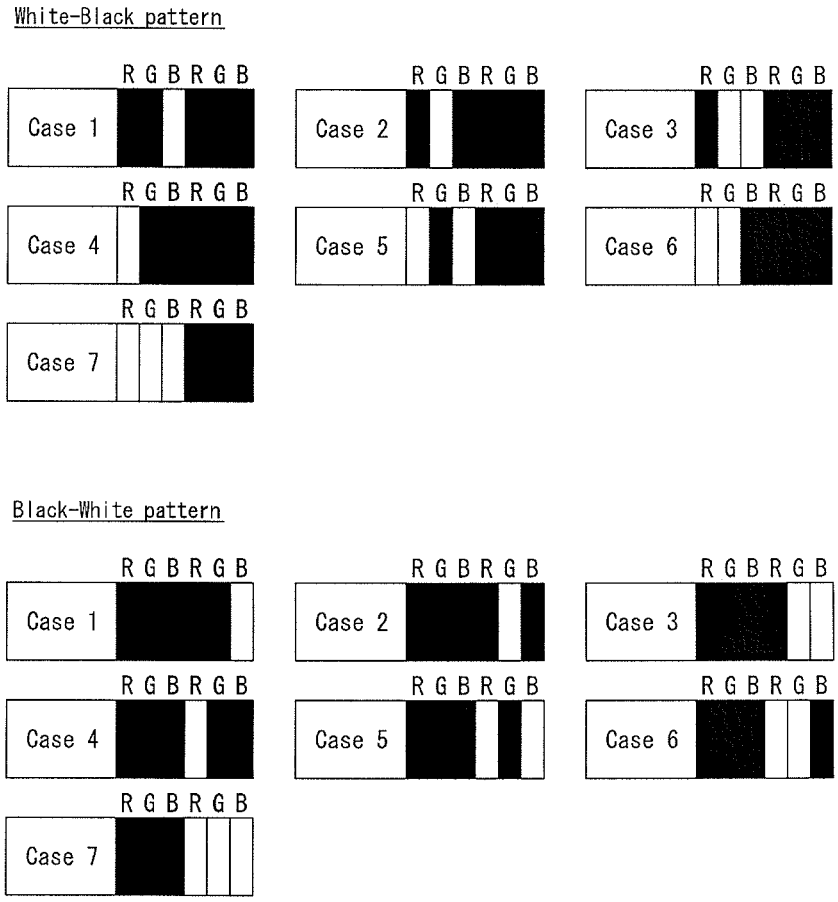
FIG. 3 (RELATED ART)

Hereinafter, exemplary embodiments of the present invention will be described in detail with reference to the attached drawings. Throughout the specification, the same reference numerals indicate substantially the same components. In connection with description of the present invention hereinafter, if it is considered that description of known functions or constructions related to the present invention may make the subject matter of the present invention unclear, the detailed description thereof will be omitted.

Terms which will be described hereinafter are established taking into consideration easiness of writing the specification into account and may vary according to manufacturer's intention or a usual practice in the related art.

Figure 4:
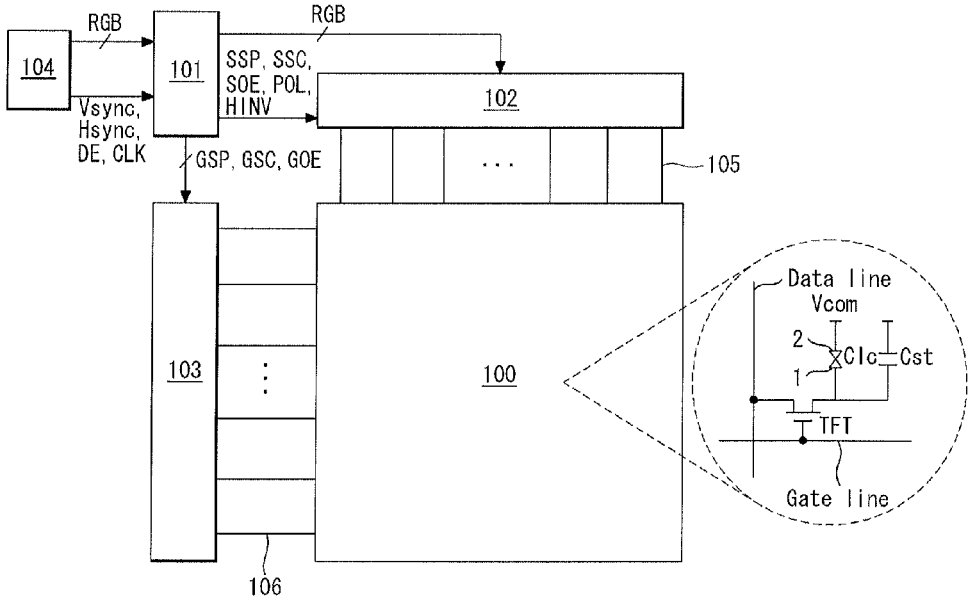
FIG. 4 is a block diagram showing a liquid crystal display according to an exemplary embodiment of the present invention.

Referring to FIG. 4, a liquid crystal display according to an exemplary embodiment of the present invention comprises a liquid crystal display panel 100, a timing controller 101, a data driving circuit 102, and a gate driving circuit 103. The data driving circuit 102 comprises a plurality of source drive integrated circuits (ICs). The gate driving circuit 103 comprises a plurality of gate drive ICs.

The liquid crystal display panel 100 comprises a liquid crystal layer interposed between two glass substrates. The liquid crystal display panel 100 comprises liquid crystal cells Clc arranged in a matrix form defined by data lines 105 and gate lines 106, which cross each other.

Figure 5:
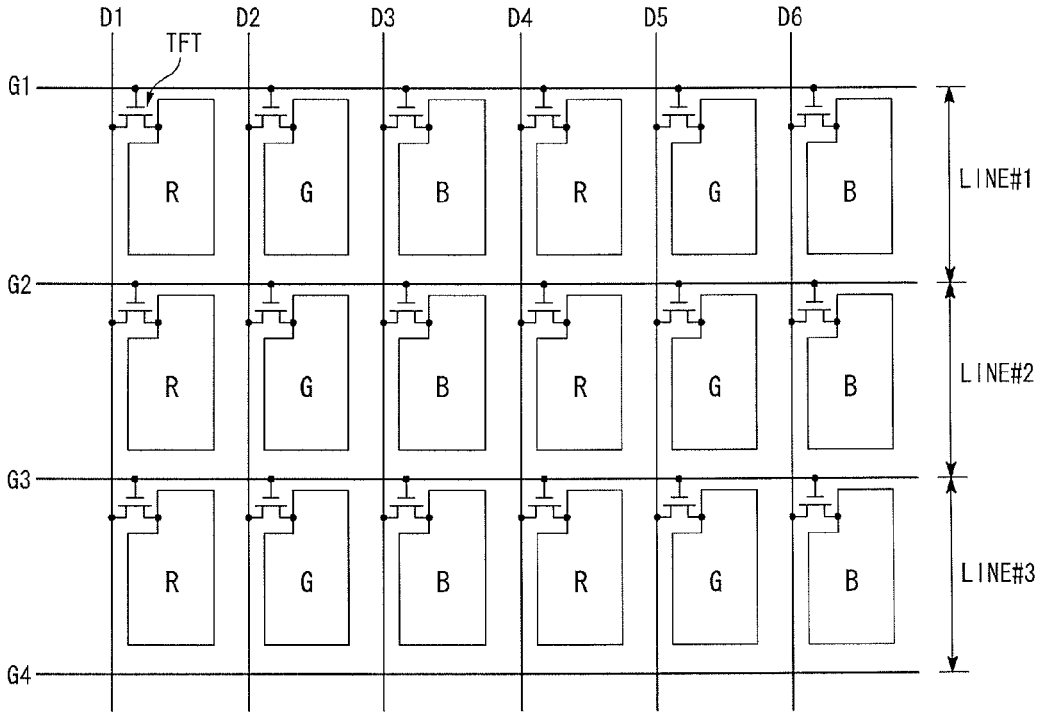
FIGS. 5 to 7 are equivalent circuit diagrams showing various examples of a pixel array shown in FIG. 4.
Figure 6:
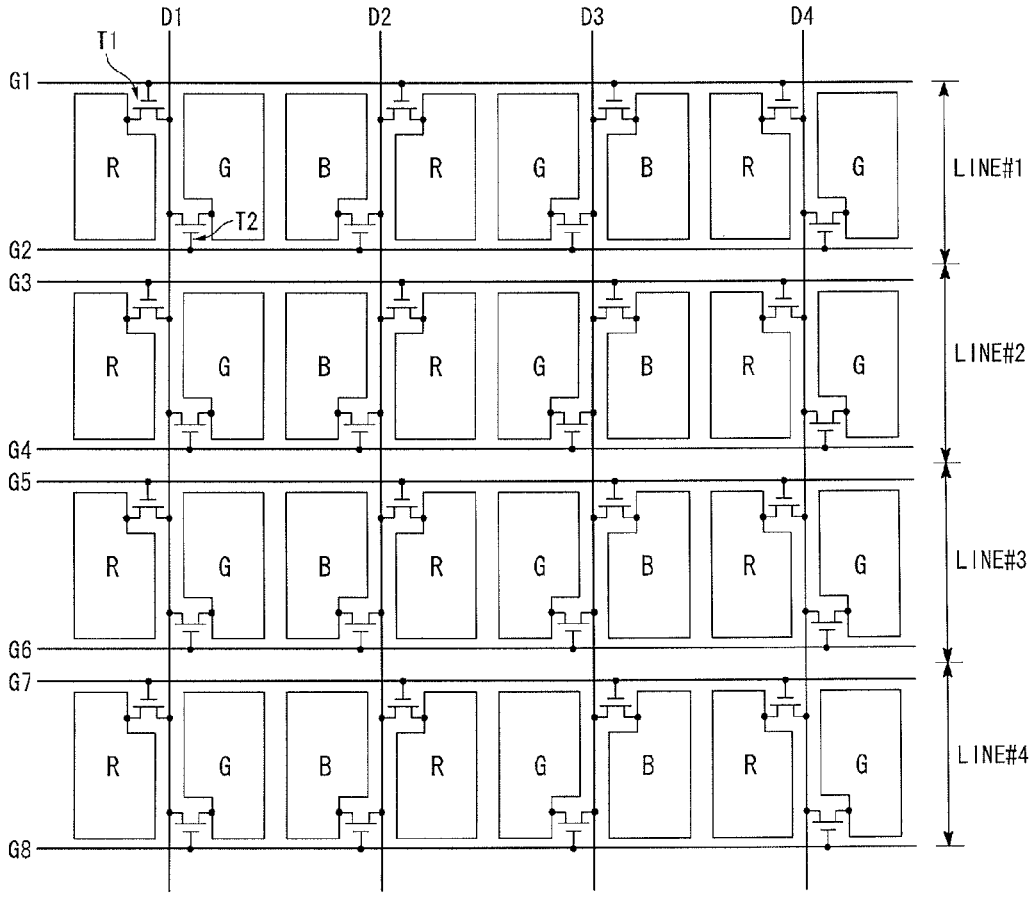
Figure 7:
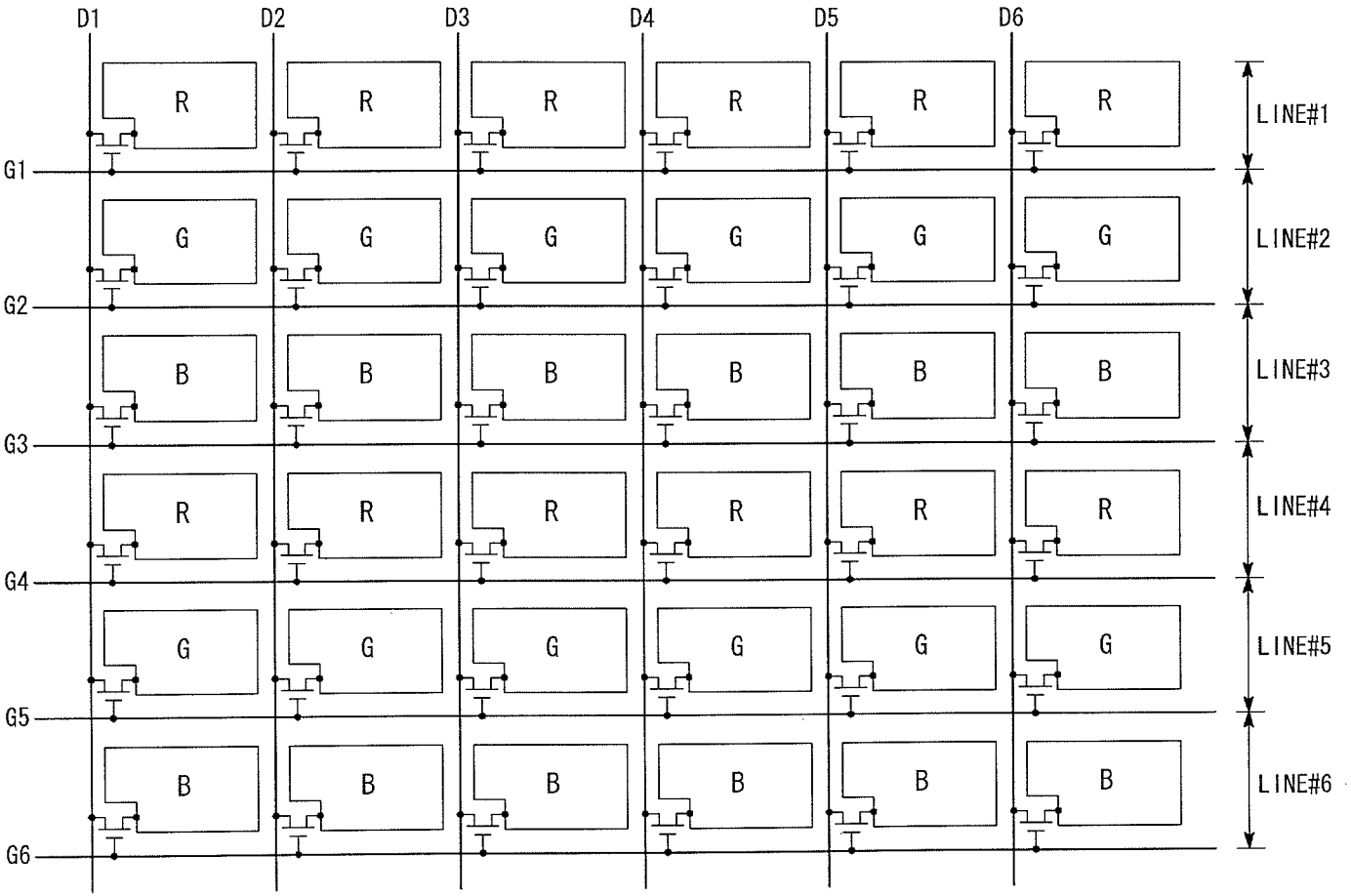

A pixel array is formed on the lower glass substrate of the liquid crystal display panel 100. The pixel array comprises the liquid crystal cells Clc formed at crossings of the data lines 105 and the gate lines 106, TFTs connected to pixel electrodes 1 of the liquid crystal cells, and storage capacitors Cst. The pixel array may be modified in various manners as shown in FIGS. 5 to 7. The liquid crystal cells Clc are connected to the TFTs and driven by an electric field between the pixel electrodes 1 and a common electrode 2. A black matrix, color filters, etc. are formed on the upper glass substrate of the liquid crystal display panel 100. Polarizing plates are respectively attached to the upper and lower glass substrates of the liquid crystal display panel 100. Alignment layers for setting a pre-tilt angle of the liquid crystal are respectively formed on the upper and lower glass substrates of the liquid crystal display panel 100.

The common electrode 2 is formed on the upper glass substrate in a vertical electric field driving method such as a twisted nematic (TN) mode and a vertical alignment (VA) mode. On the other hand, the common electrode 2 is formed on the lower glass substrate together with the pixel electrode 1 in a horizontal electric field driving method such as an in plane switching (IPS) mode and a fringe field switching (FFS) mode.

The liquid crystal display panel 100 applicable in the present invention may be implemented in any liquid crystal mode, as well as the TN mode, VA mode, IPS mode, and FFS mode. Moreover, the liquid crystal display of the present invention may be implemented in any form including a transmissive liquid crystal display, a transflective liquid crystal display, and a reflective liquid crystal display. The transmissive liquid crystal display and the transflective liquid crystal display require a backlight unit. The backlight unit may be a direct type backlight unit or an edge type backlight unit.

The timing controller 101 supplies digital video data RGB of an input image input from a system board 104 to the data driving circuit 102. Moreover, the timing controller 101 receives timing signals, such as a vertical synchronization signal Vsync, a horizontal synchronization signal Hsync, a data enable signal DE, a dot clock signal CLK, etc from the system board 104 and generates control signals for controlling the operation timing of the data driving circuit 102 and the gate driving circuit 103. The control signals comprise a gate timing control signal for controlling the operation timing of the gate driving circuit 103 and a data timing control signal for controlling the operation timing of the data driving circuit 102 and the vertical polarity of a data voltage.

The gate timing control signal comprises a gate start pulse GSP, a gate shift clock GSC, a gate output enable signal GOE, etc. The gate start pulse GSP is applied to a gate drive IC generating a first gate pulse and controls the gate drive IC so as to generate the first gate pulse. The gate shift clock GSC is a clock signal commonly input to the gate drive ICs and a clock signal for shifting the gate start pulse GSP. The gate output enable signal GOE controls an output of the gate drive ICs.

The data timing control signal comprises a source start pulse SSP, a source sampling clock SSC, a vertical polarity control signal POL, a horizontal polarity control signal HINV, a source output enable signal SOE, etc. The source start pulse SSP controls a data sampling start timing of the data driving circuit 102. The source sampling clock SSC is a clock signal for controlling a sampling timing of data in each of the source drive ICs based on a rising or falling edge. The vertical polarity control signal POL controls the vertical polarity inversion timing of data voltages output from the source drive ICs. The horizontal polarity control signal HINV is supplied to an H_2DOT optional terminal of each of the source drive ICs. A logic of the vertical polarity control signal POL is inverted every two horizontal periods when controlling the data driving circuit 102 in vertical 2-dot inversion, and is inverted every horizontal period when controlling the data driving circuit 102 in vertical 1-dot inversion. The horizontal polarity control signal HINV is generated at a high logic level when controlling the data driving circuit 102 in horizontal 2-dot inversion, and at a low logic level when controlling the data driving circuit 102 in horizontal 1-dot inversion. The source output enable signal SOE controls an output timing of the data driving circuit 102. If the digital video data to be input to the data driving circuit 102 is transmitted by a mini low voltage differential signaling (LVDS) interface standard, the source start pulse SSP and the source sampling clock SSC can be omitted.

The timing controller 101 is able to multiply the frequency of the gate timing control signal and the frequency of the data timing control signal by a frame frequency of (60xi) Hz (i is a positive integer of 2 or greater) so that the digital video data input at a frame frequency of 60 Hz can be reproduced at a frame frequency of (60xi) Hz by the pixel array of the liquid crystal display panel. The timing controller 101 can reduce the number of bits of input digital video data RGB supplied to the source drive ICs by expanding gray levels by using frame rate control (FRC). To this end, the timing controller 101 generates j-bit digital video data (j is a positive integer less than i) by adding an FRC correction value to i-bit input data video data (i is a positive integer of 6 or greater), and supplies the j-bit digital video data to the source drive ICs through the mini LVDS interface.

Figure 14:
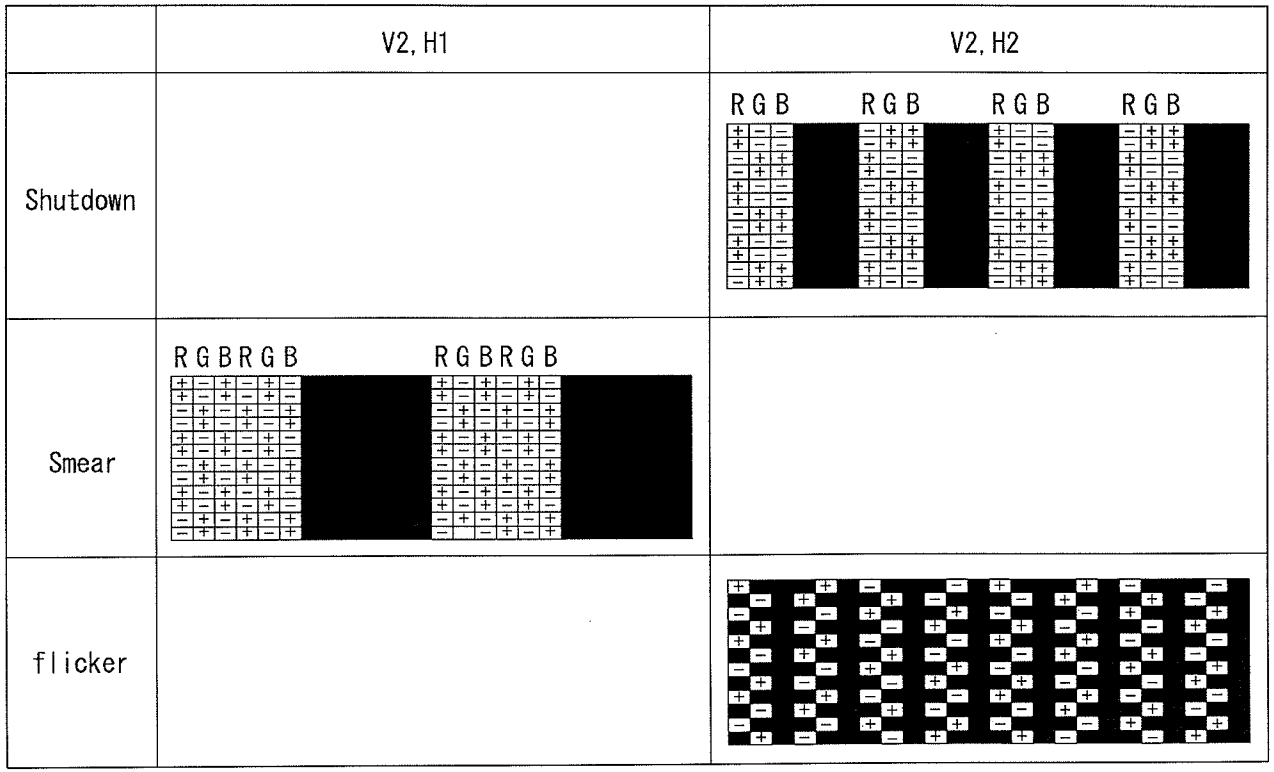
FIG. 14 is a view illustrating dot inversion which varies with the types of problem patterns in the liquid crystal display according to the exemplary embodiment of the present invention.

The timing controller 101 virtually applies a polarity pattern of horizontal 1-dot inversion and a polarity pattern of horizontal 2-dot inversion to input image data prior to supplying the input image data to the source drive ICs. Then, the timing controller 101 predicts whether a common voltage will be shifted or not, selects an optimum dot inversion for minimizing common voltage shift, and controls the polarity of the input image data by the selected dot inversion. The timing controller 101 predicts whether a common voltage will be shifted or not on the basis of virtual application of horizontal dot inversions, and, as shown in FIG. 14, controls the data driving circuit 102 by vertical 2-dot (V2) and horizontal 2-dot (H2) inversions when a shutdown pattern or flicker pattern is input and controls the data driving circuit 102 by vertical 2-dot (V2) and horizontal 1-dot (H1) inversions when a smear pattern is input.

Each of the source drive ICs of the data driving circuit 102 comprises a shift register, a latch, a digital-to-analog converter, an output buffer, etc. The data driving circuit 102 latches the digital video data RGB under the control of the timing controller 101. Then, the data drive circuit 102 converts the digital video data RGB into analog positive and negative gamma compensation voltages in response to the vertical polarity control signal POL to invert the polarity of a data voltage, and simultaneously outputs data voltages having a polarity pattern of horizontal dot inversion determined according to the horizontal polarity control signal HINV.

The gate driving circuit 103 sequentially supplies gate pulses to the gate lines 106 in response to gate timing control signals by using a shift register and a level shifter.

FIGS. 5 to 7 are equivalent circuit diagrams showing various examples of a pixel array.

The pixel array of FIG. 5 is a pixel array applied to most of liquid crystal displays, in which data lines D1 to D6 and gate lines G1 to G4 cross each other. In this pixel array, red subpixels (R), green subpixels (G), and blue subpixels (B) are respectively arranged along a column direction. Each of the TFTs supplies a data voltage from the data lines D1 to D6 to the pixel electrode of the liquid crystal cell disposed to the left (or right) of the data lines D1 to D6 in response to a gate pulse from the gate lines G1 to G4. In the pixel array shown in FIG. 5, 1 pixel comprises a red subpixel (R), a green subpixel (G), and a blue subpixel (B) that are adjacent in a row direction (or line direction) crossing the column direction. When the resolution of the pixel array shown in FIG. 5 is m×n, m×3 (where 3 is RGB) data lines and n gate lines are required. Gate pulses for one horizontal period synchronized with data voltages are sequentially supplied to the gate lines of this pixel array.

As for the pixel array shown in FIG. 6, when compared with the pixel array shown in FIG. 5, the number of data lines required at the same resolution can be reduced to a half, and the number of required source drive ICs can also be reduced to a half. In this pixel array, red subpixels (R), green subpixels (G), and blue subpixels (B) are respectively arranged along a column direction. In the pixel array shown in FIG. 6, 1 pixel comprises a red subpixel (R), a green subpixel (G), and a blue subpixel (B) that are adjacent in a line direction crossing the column direction. The liquid crystal cells adjacent in the left and right direction in the pixel array shown in FIG. 6 share the same data lines, and are continually charged with data voltages supplied in a time-division manner through the data lines. A connection relationship of the TFTs will be described by defining the liquid crystal cell and the TFT disposed to the left of the data lines D1 to D4 as the first liquid crystal cell and the first TFT (T1), and the liquid crystal cell and the TFT disposed to the right of the data lines D1 to D4 as the second liquid crystal cell and the second TFT (T2). The first TFT (T1) supplies data voltages from the data lines D1 to D4 to the pixel electrode of the first liquid crystal cell in response to gate pulses from the odd-numbered gate lines G1, G3, G5, and G7. A gate electrode of the first TFT (T1) is connected to the odd-numbered gate lines G1, G3, G5, and G7, and a drain electrode of the first TFT (T1) is connected to the data lines D1 to D4. A source electrode of the first TFT (T1) is connected to the pixel electrode of the first liquid crystal cell. The second TFT (T2) supplies data voltages from the data lines D1 to D4 to the pixel electrode of the second liquid crystal cell in response to gate pulses from the even-numbered gate lines G2, G4, G6, and G8. A gate electrode of the second TFT (T2) is connected to the even-numbered gate lines G2, G4, G6, and G8, and a drain electrode of the second TFT (T2) is connected to the data lines D1 to D4. A source electrode of the second TFT (T2) is connected to the pixel electrode of the second liquid crystal cell. When the resolution of the pixel array shown in FIG. 6 is m×n, {m×3/2} (where 3 is RGB) data lines and 2n gate lines are required. Gate pulses for ½ horizontal period synchronized with data voltages are sequentially supplied to the gate lines of this pixel array.

As for the pixel array shown in FIG. 7, when compared with the pixel array shown in FIG. 5, the number of data lines required at the same resolution can be reduced to ⅓, and the number of required source drive ICs can be also reduced to ⅓. In this pixel array, red subpixels (R), green subpixels (G), and blue subpixels (B) are respectively arranged along a line direction. In the pixel array shown in FIG. 7, 1 pixel comprises a red subpixel (R), a green subpixel (G), and a blue subpixel (B) that are adjacent in a column direction. Each of the TFTs supplies a data voltage from the data lines D1 to D6 to the pixel electrode of the liquid crystal cell disposed to the left (or right) of the data lines D1 to D6 in response to a gate pulse from the gate lines G1 to G6. When the resolution of the pixel array shown in FIG. 7 is m×n, m data lines and 3n gate lines are required. Gate pulses for ⅓ horizontal period synchronized with data voltages are sequentially supplied to the gate lines of this pixel array.

Figure 8:
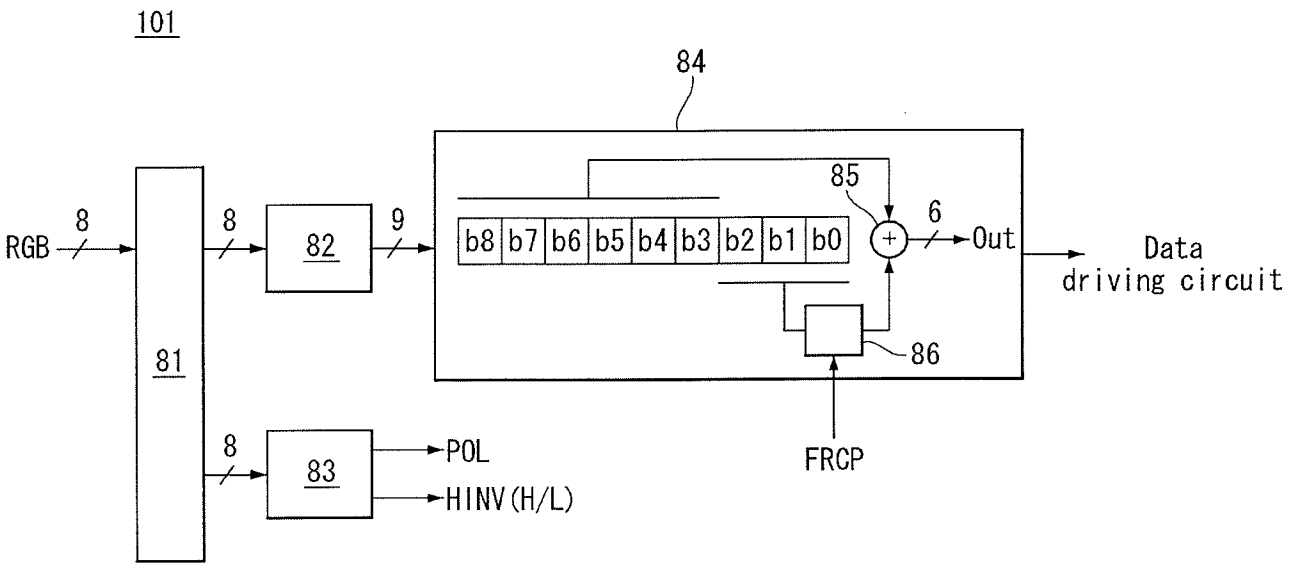
FIG. 8 is a circuit diagram showing in detail a timing controller shown in FIG. 4.

FIG. 8 is a circuit diagram showing the circuit configuration of a data processing part and a polarity control signal processing part of the timing controller 101.

Referring to FIG. 8, the timing controller 101 comprises an interface receiver 81, a bit expander 82, an FRC processor 84, and an image analyzer 83.

The interface receiver 81 receives 8-bit digital video data transmitted at an LVDS or TMDS interface standard and supplies it to the bit extender 82 and the image analyzer 83. The bit extender 82 separates the 8-bit digital video data into even-numbered pixel data and odd-numbered pixel data, and extends the data to 9-bit digital video data by appending least significant bits (LSB) to the data.

The FRC processor 84 encodes 3-bit FRC data for generating an intermediate gray level of ⅛ to ⅞ in the LSB 3 bits of the 9-bit data input from the bit extender 82, and adds an FRC correction value '1' or '0' to the MSB 6 bits (b3 to b8) of pixel data assigned by the FRC data. The FRC processor 84 outputs 6-bit data. The 6-bit data is transmitted to the source drive ICs through a mini LVDS transmitting circuit. The FRC processor 84 comprises an FRC correction value generator 86 and an adder 85. The FRC correction value generator 86 outputs a correction value (1 or 0) assigned to a pre-stored FRC pattern, and the adder 85 adds the correction value of the FRC pattern to the LSB 3 bits of the 9-bit digital video data.

Figure 9:
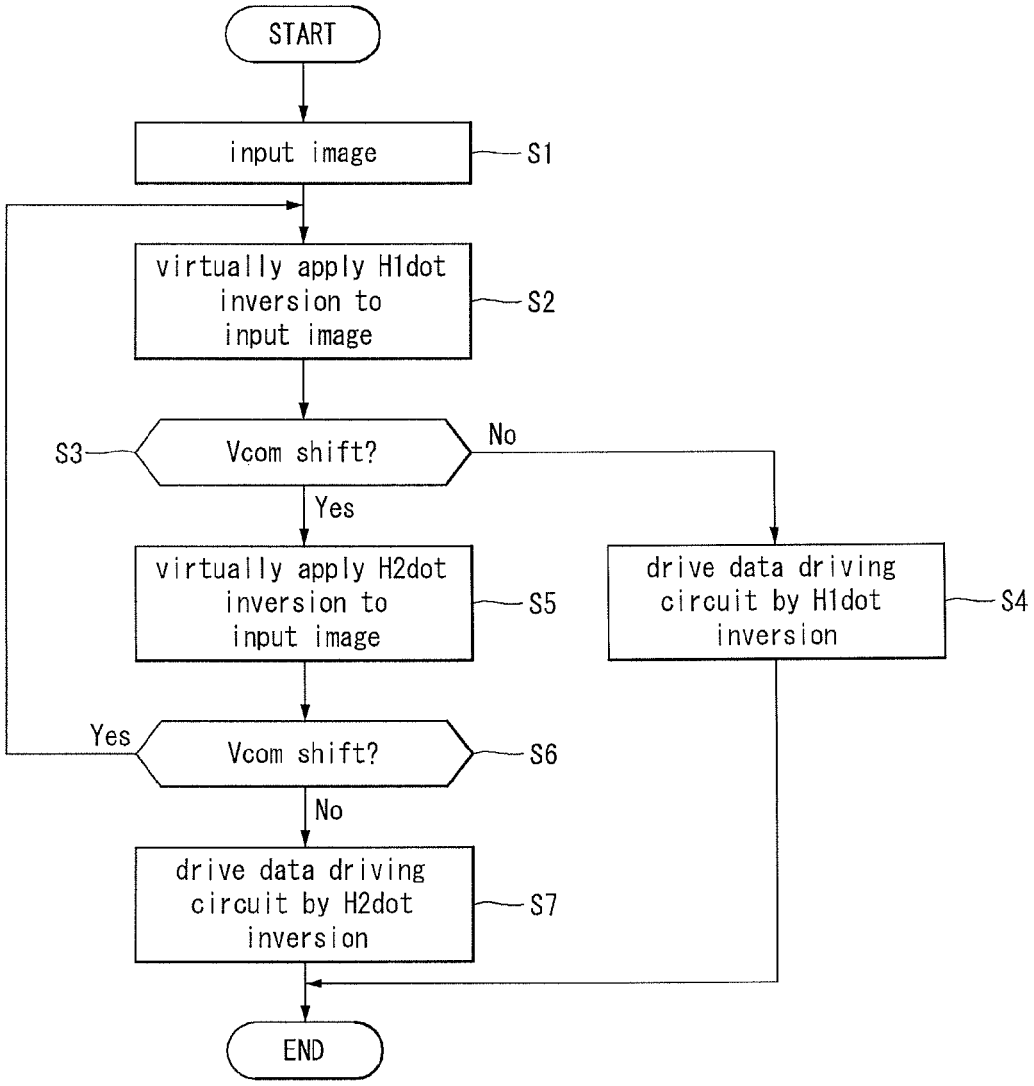
FIG. 9 is a flowchart showing the control sequence of a method of controlling dot inversion according to the exemplary embodiment of the present invention.
Figure 10:
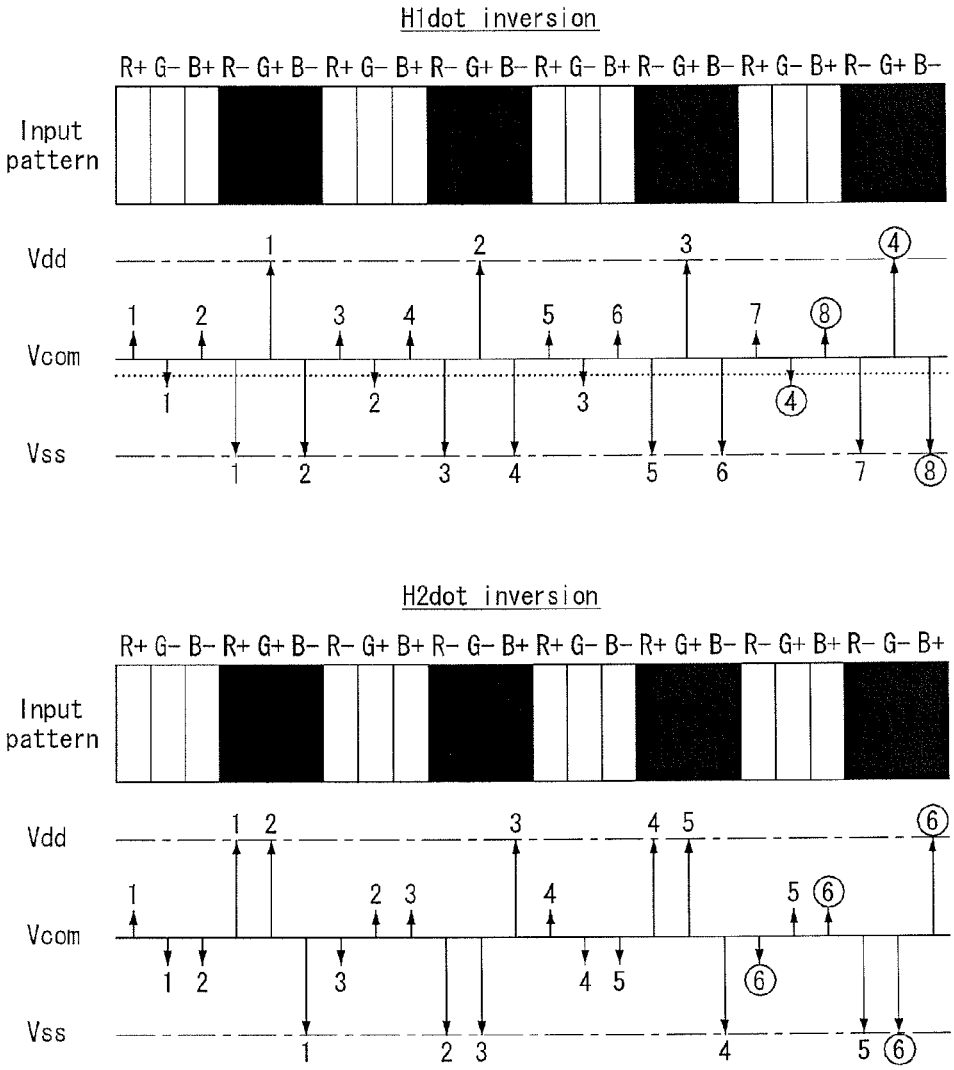
FIGS. 10 and 11 are views showing application examples of virtual dot inversion.
Figure 11:
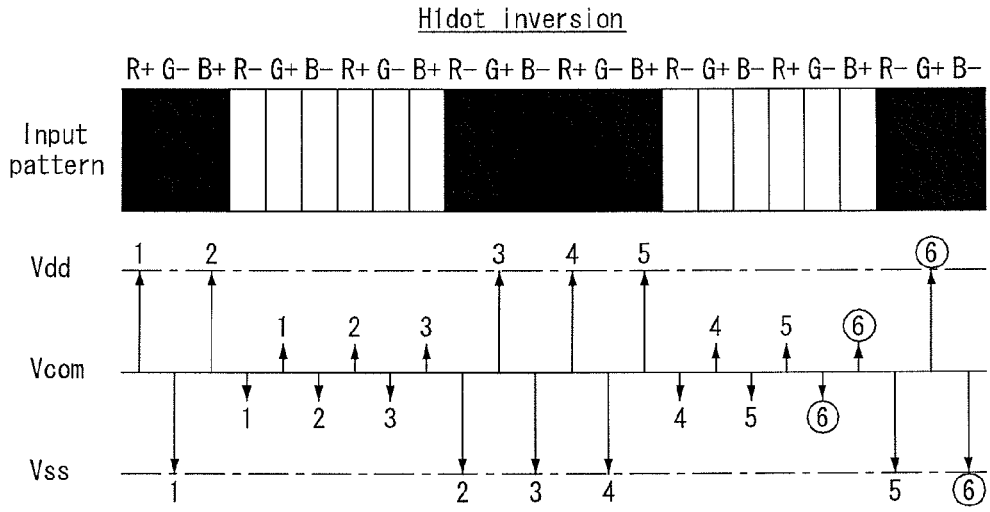
Figure 11:
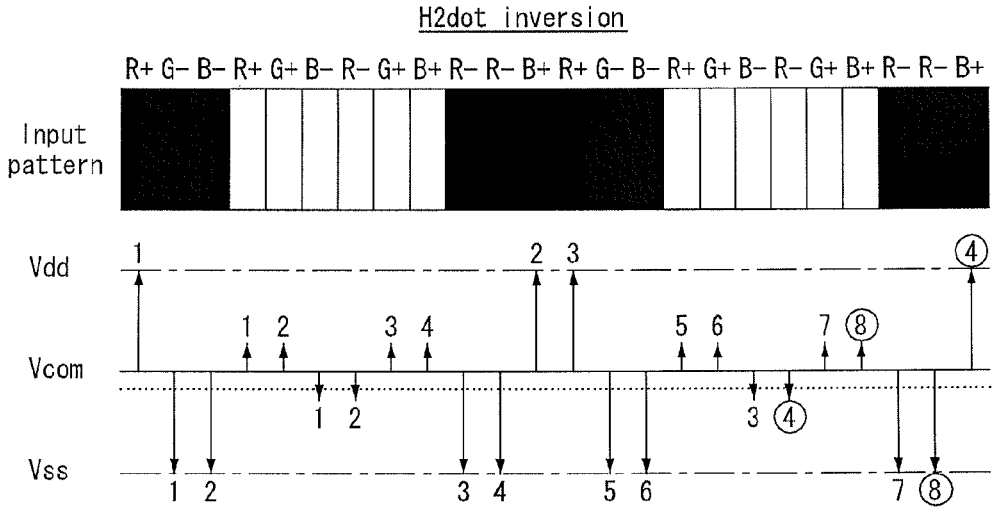

As shown in FIGS. 9 to 11, the image analyzer 83 applies two or more dot inversions having different polarity patterns to an input image and estimates a degree of dominant polarity in each of the dot inversions. Then, the image analyzer 83 generates a vertical polarity control signal POL and horizontal polarity control signal HINV for optimally controlling dot inversion polarities so that the liquid crystal display panel 100 is driven by optimum dot inversion having the lowest degree of dominant polarity. When the vertical polarity control signal POL is at a high logic level, the polarity of data voltages output from the source drive ICs is positive, and when the vertical polarity control signal POL is at a low logic level, the polarity of a data voltage output from the source drive ICs is inverted to negative. When the horizontal polarity control signal HINV is at a high logic level, the polarity of data voltages output from the source drive ICs is inverted in a horizontal 2-dot pattern H2Dot, that is, a repetitive pattern of "+ − − +" or "++−" as shown in FIGS. 10 and 11. When the horizontal polarity control signal HINV is at a low logic level, the polarity of data voltages simultaneously output from the source drive ICs is inverted in a horizontal 1-dot pattern H1Dot, that is, a repetitive pattern of "− + − +" or "+ − + −" as shown in FIGS. 10 and 11.

FIG. 9 is a flowchart showing the control sequence of a method of controlling dot inversion according to the exemplary embodiment of the present invention. FIGS. 10 and 11 are views showing application examples of virtual dot inversion.

Referring to FIGS. 9 to 11, the image analyzer 83 virtually applies horizontal 1-dot inversion to data of an input image (S1 and S2).

The image analyzer 83 maps the data of the input image to the polarity pattern of the horizontal 1-dot inversion at 1:1, and counts the number of white gray scale data mapped to positive polarity, the number of white gray scale data mapped to negative polarity, the number of black gray scale data mapped to positive polarity, and the number of black gray scale data mapped to negative polarity by using a counter. The image analyzer 83 receives accumulated counts of data in one line from the counter and calculates a difference between the number of white gray scale data mapped to positive polarity and the number of white gray scale data mapped to negative polarity. Moreover, the image analyzer 83 calculates a difference between the number of black gray scale data mapped to positive polarity and the number of black gray scale data mapped to negative polarity.

The image analyzer 83 can count the numbers of positive polarities and negative polarities of only the data of a gray scale of a high data voltage supplied to data lines. A normally white mode is a mode in which the higher a data voltage charged in a liquid crystal cell, the lower the light transmission amount of the liquid crystal cell. In the liquid crystal display of the normally white mode, the image analyzer 83 counts the numbers of positive polarities and negative polarities of only the data of a black gray scale in the input image, and calculates a difference between the number of positive black gray scale data in one line and the number of negative black gray scale data in the one line. If the difference between the number of positive black gray scale data and the number of negative black gray scale data is less than a predetermined reference value, the image analyzer 83 determines that no common voltage shift occurs when the polarity of an input image data voltage is inverted by the horizontal 1-dot inversion (S3).

When the data as shown in FIG. 11 is virtually driven by the horizontal 1-dot inversion, the number of positive black gray scale data and the number of negative black gray scale data are equal to each other, and thus there is no shift in common voltage. Accordingly, as a result of applying the virtual horizontal 1-dot inversion upon receipt of the input image shown in FIG. 11, the image analyzer 83 generates a horizontal polarity control signal HINV at a low logic and drives the source drive ICs by the horizontal 1-dot inversion (S4).

On the other hand, in the liquid crystal display in a normally black mode, the higher the voltage of a liquid crystal cell, the higher the light transmission amount. In this case, the image analyzer 83 counts the numbers of positive polarities and negative polarities of only the data of a white gray scale in the input image, and calculates a difference between the number of positive white gray scale data in one line and the number of negative white gray scale data in the one line. If the difference between the number of positive white gray scale data and the number of negative white gray scale data is less than a predetermined reference value, the image analyzer 83 drives the source drive ICs by the horizontal 1-dot inversion.

As a result of virtually applying the horizontal 1-dot inversion to the input image data, if the difference between the number of positive black gray scale (or white gray scale) data and the number of negative black gray scale (or white gray scale) data is more than the predetermined reference value, the image analyzer 83 determines that a common voltage shift occurs when the input image is driven by the horizontal 1-dot inversion. In the case that the data of FIG. 10 is driven by the horizontal 1-dot inversion, the difference between the number of positive black gray scale data and the number of negative black gray scale data is large, so that the common voltage is shifted in a direction of dominant polarity. If it is determined that a common voltage shift occurs when the input image is driven by the horizontal 1-dot inversion as a result of virtually applying the horizontal 1-dot inversion to the input image data, the image analyzer 83 virtually applies horizontal 2-dot inversion to the input image (S5). As a result of virtually applying the horizontal 2-dot inversion to the input image data, if the difference between the number of positive black gray scale (or white gray scale) data and the number of negative black gray scale (or white gray scale) data is less than the predetermined reference value, the source drive ICs are driven by the horizontal 2-dot inversion (S6 and S7). In the case that the data of FIG. 10 is driven by the horizontal 2-dot inversion, there is no difference between the number of positive black gray scale data and the number of negative black gray scale data, so that polarities are balanced, thus causing no shift in common voltage.

Figure 12:
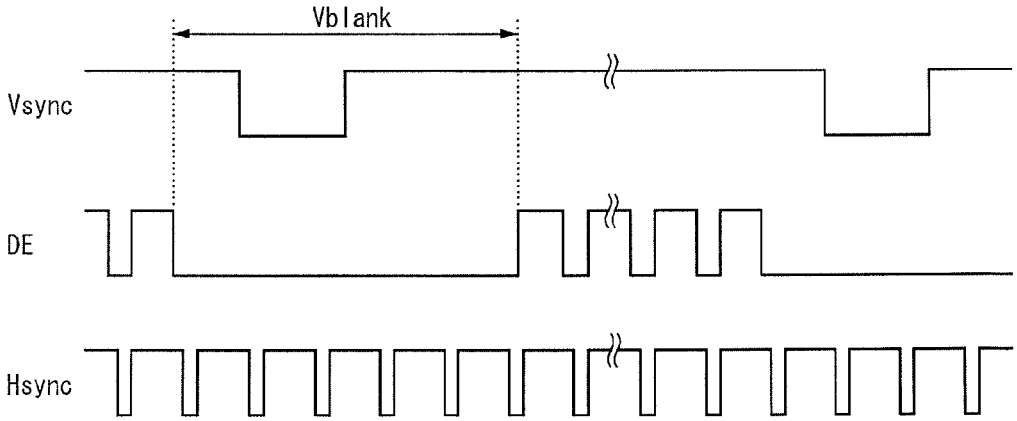
FIGS. 12 and 13 are waveform diagrams of timing signals indicative of a vertical blank time and a horizontal blank time.
Figure 13:
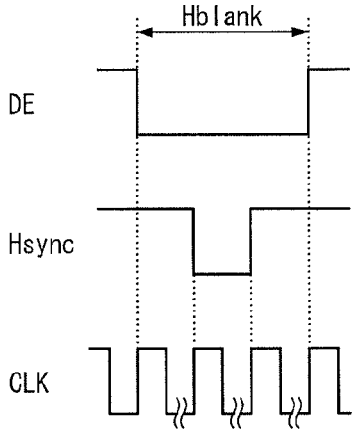

The image analyzer 83 can change the polarity control signals POL and HINV within a vertical blank time Vblank shown in FIG. 12 or within a horizontal blank time Hblank shown in FIG. 13 in order to drive the source drive ICs by the dot inversions selected in the above-described manner. The vertical blank time is a blank time between N-th frame data and (N+1)-th frame data, and the horizontal blank time is a blank time between N-th frame data and (N+1)-th frame data.

As described above, the present invention can detect a problem pattern by virtually applying a dot inversion polarity pattern to an input image and determine a dot inversion polarity pattern causing no degradation in picture quality when displaying the problem pattern. With the present invention, there is no need to define a large amount of problem patterns in advance, and hence it is not necessary to store various types of problem pattern data in a memory and no logic module is required to detect each problem pattern.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A liquid crystal display having a function of selecting dot inversion, the liquid crystal display comprising:

a liquid crystal display panel including data lines and gate lines crossing each other;

a timing controller that maps data of an input image to polarity patterns of 1-dot inversion and 2-dot inversion, counts the number of positive data and the number of negative data, determines whether any one of the positive data and negative data becomes dominant or not based on a difference between the counted numbers, and selects either one of the 1-dot and 2-dot inversions;

a data driving circuit that converts the data of the input image into data voltages to be supplied to the data lines and inverts the polarity of the data voltages by the selected dot inversion; and a gate driving circuit that sequentially supplies gate pulses synchronized with the data voltages to the gate lines, wherein, as a result of mapping the data of the input image to the polarity pattern of the 1-dot inversion, if the difference between the number of positive data and the number of negative data is less than a predetermined reference value, the timing controller drives the data driving circuit by the 1-dot inversion, and as the result of mapping the data of the input image to the polarity pattern of the 1-dot inversion, if the difference between the number of positive data and the number of negative data is more than the predetermined reference value, the timing controller maps the data of the input image to the polarity pattern of the 2-dot inversion and re-calculates the difference between the number of positive data and the number of negative data, and if the difference is less than the predetermined reference value, the timing controller drives the data driving circuit by the 2-dot inversion.

2. The liquid crystal display of claim 1, wherein the timing controller generates a polarity control signal that drives the data driving circuit by the 1-dot inversion and the 2-dot inversion, and the polarity control signal is changed within either a vertical blank time or a horizontal blank time with respect to the dot inversion selected by the timing controller.

3. A method of selecting dot inversion of a liquid crystal display, the method comprising:

mapping data of an input image to polarity patterns of 1-dot inversion and 2-dot inversion and counting the number of positive data and the number of negative data;

selecting either one of the 1-dot and 2-dot inversions by determining whether any one of the positive data and negative data becomes dominant or not based on a difference between the number of positive data and the number of negative data;

converting the data of the input image into data voltages, inverting the polarity of the data voltages by the selected dot inversion, and supplying the data voltages to data lines of a liquid crystal display panel; and sequentially supplying gate pulses synchronized with the data voltages to gate lines of the liquid crystal display panel, wherein the selecting of either one of the 1-dot and 2-dot inversions by determining whether any one of the positive data and negative data becomes dominant or not based on the difference between the number of positive data and the number of negative data comprises:

as a result of mapping the data of the input image to the polarity pattern of the 1-dot inversion, if the difference between the number of positive data and the number of negative data is less than a predetermined reference value, driving the data driving circuit by the 1-dot inversion; and as the result of mapping the data of the input image to the polarity pattern of the 1-dot inversion, if the difference between the number of positive data and the number of negative data is more than the predetermined reference value, mapping the data of the input image to the polarity pattern of the 2-dot inversion and re-calculating the difference between the number of positive data and the number of negative data, and if the difference is less than the predetermined reference value, driving the data driving circuit by the 2-dot inversion.

4. The method of claim 3, further comprising:

generating a polarity control signal which is changed according to the selected dot inversion; and controlling a data driving circuit outputting the data voltages by the polarity control signal.

5. The method of claim 4, wherein the polarity control signal is changed within either a vertical blank time or a horizontal blank time with respect to the dot inversion selected by the timing controller.

* * * * *